US006026626A

United States Patent [19]

Fisher

[11] Patent Number: 6,026,626

[45] Date of Patent: Feb. 22, 2000

[54] TRUSS

[76] Inventor: Mark Eliott Fisher, Tomcat U.S.A., Inc., P.O. Box 550, Midland, Tex. 79702

[21] Appl. No.: 08/902,404

[22] Filed: Jul. 29, 1997

[30] Foreign Application Priority Data

Aug. 9, 1996 [GB] United Kingdom ..... 9616754

[51] Int. Cl.[7] ..... E04B 1/18; E04C 3/02

[52] U.S. Cl. ..... 52/633; 52/638; 52/650.1; 52/650.3; 52/28

[58] Field of Search ..... 52/633–636, 638, 52/650.1, 650.3, 652.1, 653.1, 653.2, 690, 693, 28, 40; 246/477; 104/7

[56] References Cited

U.S. PATENT DOCUMENTS

| | | | |
|---|---|---|---|
| 3,978,635 | 9/1976 | Theault | 52/693 |
| 4,494,349 | 1/1985 | Clements | 52/633 |
| 4,862,336 | 8/1989 | Richardson et al. | 52/28 X |
| 4,866,583 | 9/1989 | Targetti | 52/28 X |
| 5,205,101 | 4/1993 | Swan et al. | 51/650.1 |
| 5,335,468 | 8/1994 | Oberman et al. | 52/690 X |
| 5,551,199 | 9/1996 | Hayes et al. | 52/653.1 X |
| 5,711,131 | 1/1998 | Thomas | 52/653.2 X |
| 5,822,945 | 10/1998 | Muller | 52/690 X |

FOREIGN PATENT DOCUMENTS

| | | |
|---|---|---|
| 3-51460 | 3/1991 | Japan . |
| 859752 | 11/1956 | United Kingdom . |
| 1088460 | 7/1965 | United Kingdom . |
| 1320777 | 6/1969 | United Kingdom . |

*Primary Examiner*—Carl D. Friedman
*Assistant Examiner*—Winnie S. Yip
*Attorney, Agent, or Firm*—Jones, Day, Reavis & Pogue

[57] ABSTRACT

An elongate truss 10 comprises a framework 14 of spars 16, 18, 20, 22, 24, 26. The truss 10 is open on one aspect and has the transverse cross section of a regular trapezium. This enables identical trusses to be stacked up for storage or transporting an internested manner one on top of the other. In addition, lights 62 may be mounted inside the truss 10 and drapes 72 are hung from one side of the truss 10. A removable cross brace 42 may be provided for connection at the open aspect of the truss between lower longitudinal spars 18 to prevent splaying of the truss when under load. The brace 42 may be stored by attachment to intermediate cross chords 22. A stack 10' of trusses may be stored on a trolley 28 and easily manhandled. A substantial number of the trusses, when stacked, may be stored in a set volume.

18 Claims, 4 Drawing Sheets

TRUSS

FIELD OF THE INVENTION

The present invention relates to a truss, such as a truss for suspending lighting or other concert or performance equipment or for suspending exhibition equipment such as lighting, banners and display monitors. In particular, the invention concerns a modular truss which may be connected to other similar trusses to build a combined truss arrangement for suspending lighting or other concert or exhibition equipment at a concert or theater venue, exhibition or such like, such as on a temporary basis, in association with a touring production, during concert touring.

DESCRIPTION OF RELATED ART INCLUDING INFORMATION DISCLOSED UNDER 37 CFR 1.97 AND 1.98

It is known to provide a truss with a framework comprising interconnected spars, the truss being elongate and having a square or triangular transverse cross section. While assembled truss arrangements of this nature are usually sufficiently strong to provide the required support to concert equipment, they take up a great deal of room once disassembled and are thus expensive to store and transport.

One known development which aims to overcome this problem is to provide trusses in which the spars are foldable to take up less room for storage or transport. However, the folding nature of these trusses means that they are inherently rather weak.

SUMMARY OF THE INVENTION

The present invention aims to alleviate the problems of the prior art.

According to one aspect of the present invention there is provided a truss for suspending concert or performance equipment, the truss having a body which is internestable with an identical truss in a storage configuration thereof.

Accordingly to another aspect of the invention there is provided a truss for suspending concert or performance equipment such as lighting, the truss having an elongate body which is open to an open aspect thereof, an opposite aspect of the body being internestable with the said one aspect of an identical truss.

The internestable nature of the truss with others which are identical or similar to it makes it possible to provide a truss arrangement made up in modules by a plurality of similar or identical trusses, which can be disassembled to a storage or transport configuration in which the volume taken up by the internested structure is minimized. This is highly advantageous since the result is that the cost of transporting the truss arrangement is minimized.

When the truss is elongate, it is possible to place one truss on one or more support trolleys and to stack several similar trusses on top of it. The trolley can be manipulated very conveniently.

The truss and trolleys may be conveniently sized and dimensioned for fitting several stacked piles of trusses alongside one another in a storage compartment, such as in a truck, standard shipping or air freight container.

The body of the truss of the first above mentioned aspect of the invention is preferably elongate and open to an open aspect thereof, and an opposite aspect of the body is preferably internestable with the said one aspect of an identical truss.

There now follows a discussion of various preferred features of the truss which may be incorporated in trusses according to either one or both of the above mentioned aspects of the invention.

The body of the truss preferably comprises a framework of interconnected spars. The spars may be tubular and preferably are of metal, although the use of various other materials, such as plastics, e.g. polypropylene or a carbon fiber or other reinforced matter, is envisaged. The spars are preferably fixed relative to one another and, when made of metal, may be fixed relative to one another by welding. This provides a truss which is rigid and has a high amount of strength in relation to its weight.

Instead of being formed as a framework of interconnected tubular spars, the body of the truss, may, in alternative embodiments, be made as a molded or extrusion form of material such as plastics, such as polypropylene or a carbon fiber reinforced plastics material, or metal.

The body may be saddle-shaped, having an elongate channel extending along the length thereof on the said open aspect, preferably substantially along the entire length of or entirely along the length thereof. This saddle-shaped configuration enables one truss to be stacked on top of and internested with another similar or identical one. This is a particularly volume-efficient manner in which to store trusses of elongate nature.

Preferably, the framework and form of the truss is adapted to define, in use, an elongate top and two elongate sides of the body. The top is preferably flat and spaces the two sides apart. The sides, in transverse section, are preferably tapered apart, becoming further spaced apart with increasing distance away from the top. The truss may be configured with the flat top horizontal and the two sides extending downwardly from the top and it is envisaged that the truss will often be set up in this configuration. However, it is also envisaged that it could be set up and configured in use with the top at the side or even the bottom of the truss and, in the latter case, the sides may then extend upwardly from the top. The word top has therefore been used in this specification to describe the truss when in its most usual anticipated configuration. In the case of a molded form, the top and sides may be discontinuous, comprising a webbed framework, with webbed spars of the framework being separated by holes to reduce the amount of material required for the truss and/or to provide suitable equipment mounting locations on the truss. Likewise, in the case of an extruded form, the amount of material required for the truss may be reduced and mounting locations provided by removing material subsequent to extrusion, to result in a webbed or holed framework, e.g. having webbed spars.

In a horizontal orientation of the top of the framework or form, each side thereof, in transverse section, may taper from the vertical by an angle of between 10 and 45 degrees, preferably being between 15 and 25 degrees, about 20 degrees being preferably, the angle being 20.5 degrees in one example. In some embodiments, the angle of taper may be more than 45 degrees or less than 10 degrees.

The framework preferably includes two spaced apart longitudinal spars on the open aspect of the body and at least one longitudinal spar on the said opposite aspect of the body. Preferably, two said longitudinal spars are provided on the said opposite aspect of the body and these are preferably interconnected to one another by a series of cross chords.

Preferably, all adjacent ones of the longitudinal spars are interconnected by cross chords, apart from the longitudinal spars of the framework of the body which are located on the open aspect thereof. The cross chords and longitudinal spars may define planar or curved surfaces of the truss. The truss may include three rectangular planar braces, each being defined by two longitudinal spars and interconnecting cross chords at the ends thereof. As well as the end cross chords, each two adjacent longitudinal members (apart from those on the open aspect) may be interconnected by diagonal bracing spars or cross chords that are perpendicular to the longitudinal length thereof.

The truss may, as an accessory, include a removable cross brace which is releasably mountable between the longitudinal spars of the open aspect of the body, preferably by means of snap fit connectors. The removable cross brace prevents outward splaying of the longitudinal spars on the open aspect of the body which might otherwise occur with the truss subjected to substantial load. A cross brace of this nature may, naturally, be employed in the case of extruded or molded forms.

When a cross brace is provided and two longitudinal spars are provided on the opposite aspect of the truss interconnected by a series of cross chords, the two longitudinal spars of the open aspect of the body are preferably spaced apart by the same distance as two cross chord of the series of cross chords on the opposite aspect of the body, and the removable cross brace is preferably interchangeably mountable at ends thereof either between the two longitudinal spars of the open aspect or between the said two chords of the series of the cross chords. Thus, the removable cross brace may be positioned at the open aspect of the truss to strengthen it while in use and, for internesting or stacking of the truss for storage or transport, may be conveniently held in position extending in a longitudinal direction of the truss between two of the series of cross chords on the aspect of the truss opposite the open aspect.

In a most preferred embodiment, the framework has four parallel longitudinal spars, the four parallel longitudinal spars, in transverse section, having the shape of a regular trapezium, the longer of the parallel sides of the trapezium being on the open aspect of the body.

The longitudinal spars may be straight to provide a straight truss, or curved to provide a curved truss. In either case, all of the longitudinal spars are preferably parallel, consisting of translations of one another in three dimensional space.

The cross chords and cross brace (when provided) are preferably straight.

When the truss includes four parallel longitudinal spars, these are preferably interconnected at each end thereof by three and cross chords which are adapted, in use, to form respective top and side end chords of the framework. The side end chords are preferably interconnected by a bracing tie-bar which is spaced from and parallel to the top end chord, each tie-bar having lower surface which is approximately the same length as or up to about 5 or 10% longer than the distance across the top of the truss adjacent the top end chord.

In preferred embodiments, the tie-bar is connected to each side end chord a distance more than 50%, preferably more than 75%, such as about 85%, of the distance along each side end chord from the open aspect of the truss. The tie-bar not only provides bracing for the truss, but may support the truss on top of another similar truss when stacked or internested, so that the side end chords of adjacent trusses do not engage one another. This is particularly important when the truss has tapered sides since it prevents the weight of trusses stacked upon one another from causing splaying of the sides of stacked trusses.

The truss may be provided with a catwalk deck extending along a longitudinal direction thereof. When the truss has an elongate flat top and sides, the catwalk may be located adjacent the flat top, preferably located, above it, with respect to gravity.

The truss may include a handrail which is releasably mountable to the body, such as by snap fit connectors. The catwalk and handrail enable technicians or even performers to move along the truss safely, such as when it is suspended above a concert set.

According to another aspect of the invention there is provide a modular truss structure which includes two trusses, each said truss being in accordance with one or both of the above mentioned aspects of the invention, each truss being elongate and having two ends, the two trusses being joined to one another end to end.

According to another aspect of the invention there is provided a truss in accordance with one or both of the first two other mentioned aspect of the invention, in combination with a lamp, the lamp being connected to the truss inside the body of the truss. The truss when it has an open aspect, enables a relatively large portion of the lamp mounting and other ancillary equipment to be located, in use, inside the body of the truss, thus providing an aesthetic arrangement, as is particularly important for concerts and similar performances.

According to another aspect of the invention, there is provided a truss as set out in either or both of the first two above mentioned aspects of the invention, in combination with a drape, the drape hanging from one side of the truss.

Another aspect of the invention provides a stacked truss arrangement comprising at least two trusses, each said truss being as set out in one or both of the first two above mentioned aspect of the invention, the two trusses being stacked on top of and internested with one another. The bottom one of the trusses may be supported on a trolley and, in this case, the trolley may include side supports which are adapted to prevent outward movement of bottom portions of the bottom truss. Such movement might otherwise occur with a truss with tapered sides as discussed above, if a substantial number of similar trusses were stacked on top of it.

The present invention also envisages any combination of any of the features of the above mentioned aspects of the invention and the preferred other features discussed herein which is not specifically set out herein.

BRIEF DESCRIPTION OF THE DRAWINGS

The present invention may be carried out in various ways and several trusses for suspending concert or performance equipment in accordance with the invention will now be described by way of example with reference to the accompanying drawings in which.

DETAILED DESCRIPTION OF THE PREFERRED EMBODIMENT(S)

Figure 1:
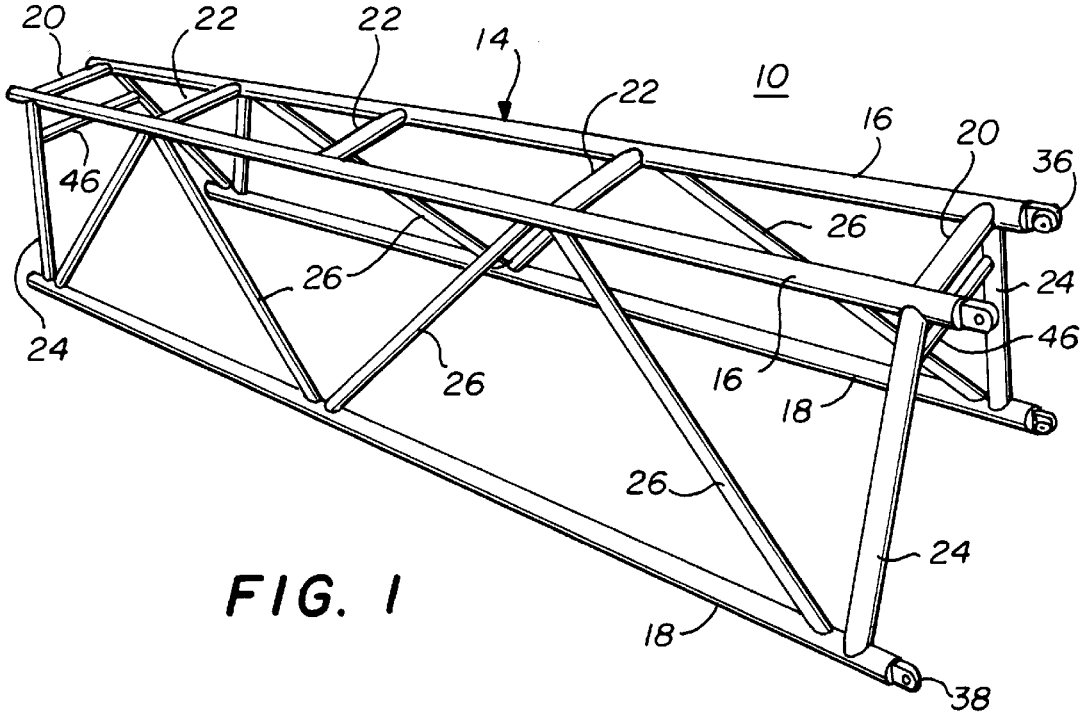
FIG. 1 is a perspective view of a preferred exemplary embodiment of a lighting truss in accordance with the present invention.

As FIG. 1 shows, a lighting truss 10 in accordance with one exemplary preferred embodiment of the invention comprises a body 12, the body comprising a tubular spar framework 14. The framework 14 includes two straight upper longitudinal spars 16 and two straight lower longitudinal spars 18. The four longitudinal spars are parallel to each other.

The upper longitudinal spars 16 are connected to one another by two end cross chords 20 which, together with intermediate cross chords 22 form a series of cross chords extending between the two upper longitudinal spars, perpendicular thereto, and defining a top of the truss.

Each of the upper longitudinal spars 16 is also connected to the adjacent one of the lower longitudinal spars 18 by side end cross chords 24 and diagonal braces 26. Each of the upper longitudinal spars, defines, together with the adjacent one of the lower longitudinal spars and side end chords and diagonal braces to which it is connected, a side of the truss.

All of the spars, that it to say the upper and lower longitudinal spars 16, 18, the end cross chords 20, the intermediate cross chords 22, the side end cross chords 22, the side end cross chords 24, and the diagonal braces 26, are straight and are fixed to one another. These spars are preferable all metal, such as aluminum or an aluminum alloy.

It will be noted that there are no cross chords which interconnect the two lower longitudinal spars 18. The lower aspect of the truss is therefore open.

Figure 2:
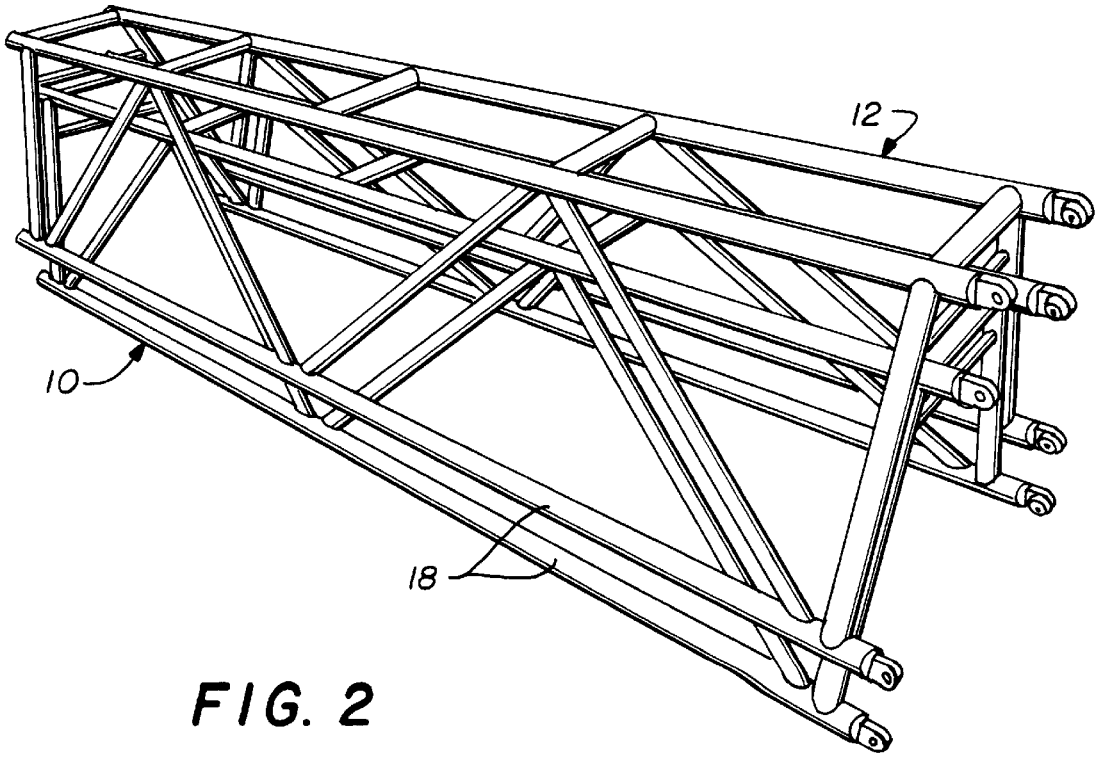
FIG. 2 shows the truss of FIG. 1 internested for storage or transport with an identical truss.
Figure 3:
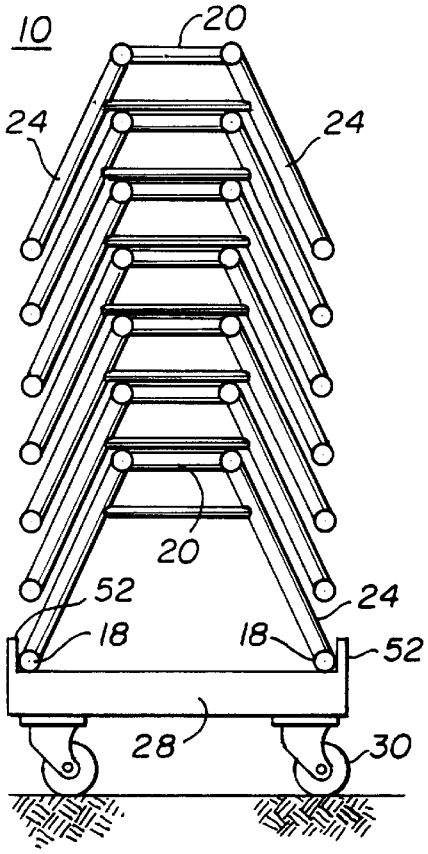
FIG. 3 shows a schematic end view of the truss of FIG. 1 stacked on a trolley with five identical trusses.
Figure 5:
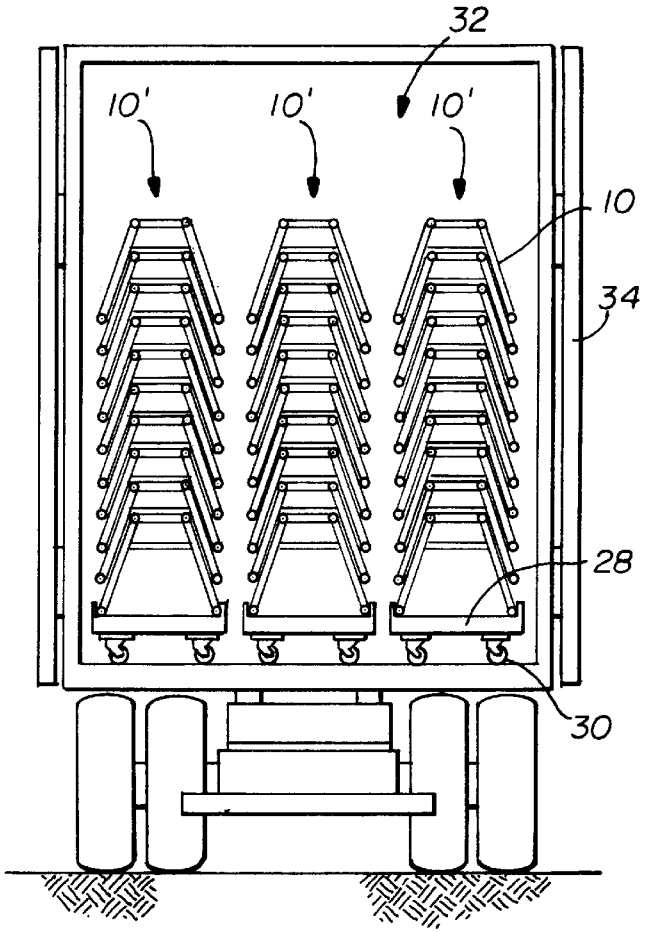
FIG. 5 is a schematic end view of three stacks of trusses on trolleys similar to the stack shown in FIG. 3, loaded into a truck for transport.

As the end view of the truss of FIG. 3 shows, the side end cross chords 24 extend outwardly as they extend away from the end cross chords 20. Overall, the truss body 12 is therefore saddle-shaped and in transverse section or end view has the shape of a regular trapezium. The open nature of the lower aspect of the truss enables its upper aspect to be internested inside the lower aspect of a similar or identical truss and FIG. 3 shows six identical trusses 10 stacked on top of one another. FIG. 2 shows two trusses like the one shown in FIG. 1 stacked on top of one another. It will be noted that the internesting or stacking nature of the trusses enables a relatively large amount of the trusses 10 to be stacked for storage or transport within a set volume. This is extremely advantageous and a practical application of the ability of the trusses to stack is shown in FIG. 5 in which three stacks 10' are shown stacked on trolleys 28 on castors 30 inside the storage space 32 of a truck 34. Thus, it is possible to load a substantial number of the trusses 10 onto one or more trolleys 28 in a stack 10' (a trolley may be provided at each longitudinal end of the stack), and a substantial number of the trusses 10 may therefore be manhandled all together, with the minimum effort. Furthermore, the number of individual trusses 10 that can be transported in a particular storage space 32 is maximized, thereby reducing transport costs. This is particularly advantageous for lighting trusses of the type which are used during concert touring for suspending concert equipment such as lighting above performers such as bands.

Figure 4:
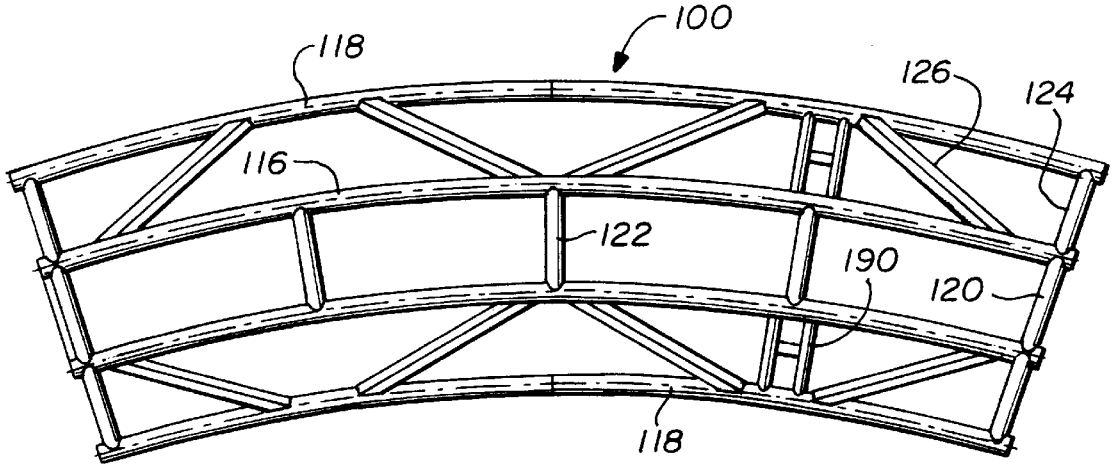
FIG. 4 is a plan view of a second preferred exemplary embodiment of a lighting truss in accordance with the present invention.

The stacking principle is not only applicable to trusses 10 with straight longitudinal members 16,18, but can be embodied in curved trusses as shown in FIG. 4, where the upper 116 and lower 118 longitudinal spars are curved in plan view, but are parallel to one another. All of the spars of the body of the truss 100 are straight apart from the upper 116 and lower longitudinal spars 116,118 and reference numerals for spars equivalent to those shown in FIG. 1 have 100 added on to them in the truss of FIG. 4. The truss shown in FIG. 4 also includes optional equipment supports 190 extending between the upper 116 and lower 118 longitudinal spars, and the supports 190 may be conveniently used for mounting lighting or other equipment inside the truss 100.

Figure 6:
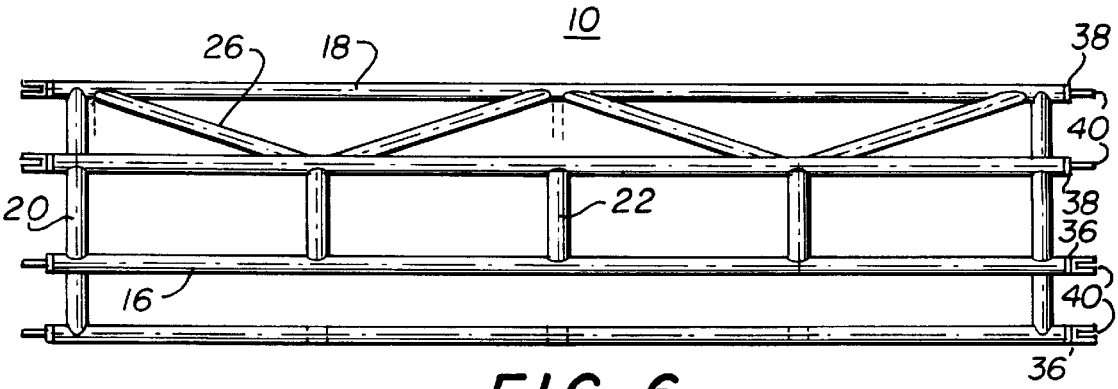
FIG. 6 is a part top plan view of a slightly modified version of the truss of FIG. 1.

In use, the truss 10 of FIG. 1 may be connected end to end with a similar truss by connectors in the form of yoke members 26 (see FIG. 6) mounted on the ends of the longitudinal spars on one side of the truss 10 which are interengageable with flanges 38 mounted to the ends of the longitudinal spars 16,18 on the other side of the truss 10. The flanges 38 of one truss 10 may be slid into the yokes 36 of another truss and then bolts (not shown) may be inserted through holes 40 in the yoke members 36 and flanges 38 to secure the two trusses relative to one another. FIG. 6 is a partial view in that the diagonal braces 26 of one side of the truss 10 are not shown in that drawing. It will be appreciated that the truss 10 of FIG. 6 is slightly modified with respect to the truss 10 of FIG. 1 in that the positioning of the yoke members 36 and flanges 38 is reversed from one side of the truss to the other, i.e. in FIG. 6, the yokes 36 are on the right side of each end of the truss when viewed from above, whereas in the truss of FIG. 1 they would be on the left if the truss were viewed from above.

Figure 7:
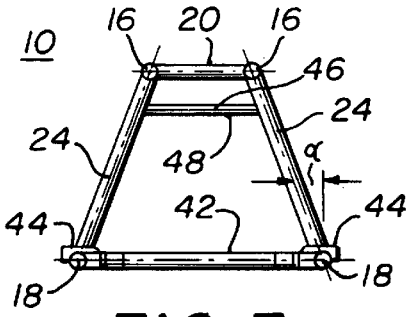
FIG. 7 is an end view of the truss of FIG. 1, including an optional removable cross brace.
Figure 8:
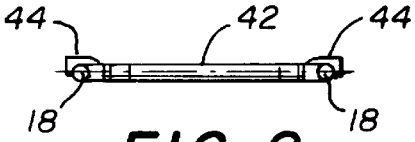
FIG. 8 is a side view of the cross brace shown in FIG. 7.

FIG. 8 shows a removable cross brace 42 which has at each end thereof of a jaw 44. The jaws 44 may be secured to the lower longitudinal spars 18 of the truss 10 by a snap fit securement. The purpose of the removable brace 42 is to prevent splaying of the lower longitudinal spars 18 of the truss 10 when the truss is under substantial load. The distance between the two lower longitudinal spars 18 is the same as the distance between the cross chords 20,22 which extend between the top longitudinal spars 16 of the truss 10. Accordingly, the cross brace 42 may be removed from the position shown in FIGS. 7 and 13 where it extends between the lower longitudinal spars 18 and may be mounted between two of the cross chords 20, 22 for storage or transport.

Figure 10:
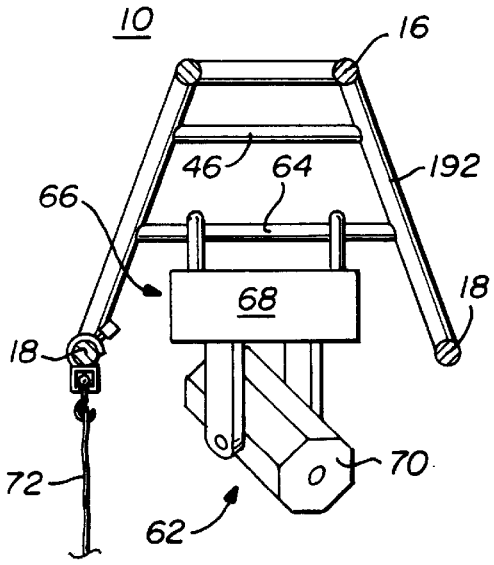
FIG. 10 is a schematic end view of the truss of FIG. 1, with a lamp and drape mounted thereto.
Figure 11:
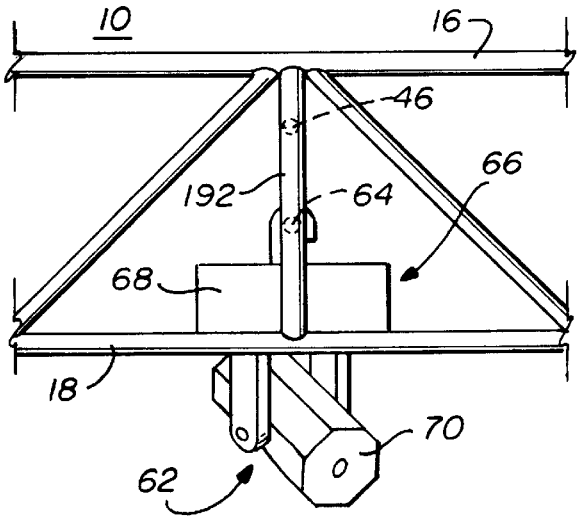
FIG. 11 is a part side view corresponding to FIG. 10.
Figure 12:
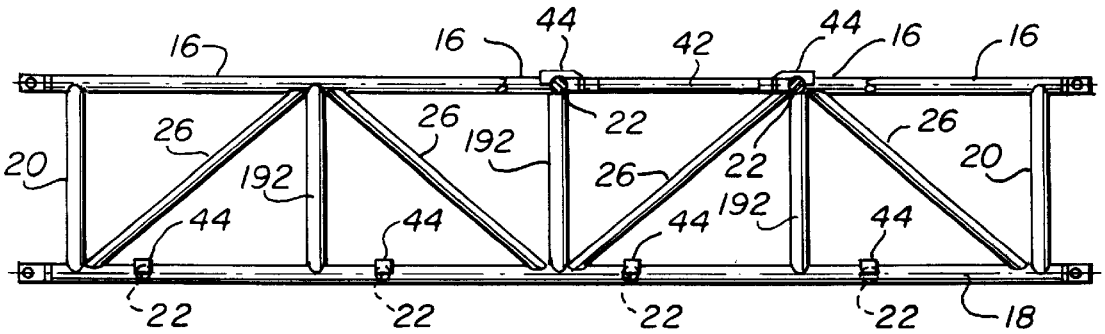
FIG. 12 shows a side view of another preferred embodiment of a truss in accordance with the invention.
Figure 13:
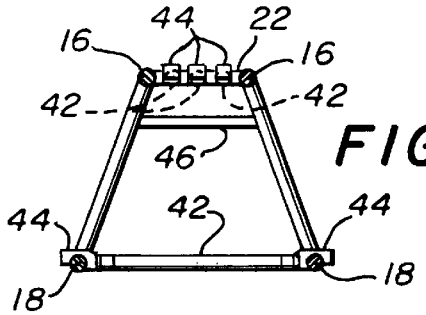
FIG. 13 is an end view of the truss of FIG. 12.

It will be noted that the truss 10 of FIGS. 12 and 13 is a slightly modified version of the truss shown in FIG. 1, in that the truss of FIGS. 12 and 13, which is similar in this respect to the truss of FIGS. 10 and 11, includes additional side cross chords 192.

Figure 9:
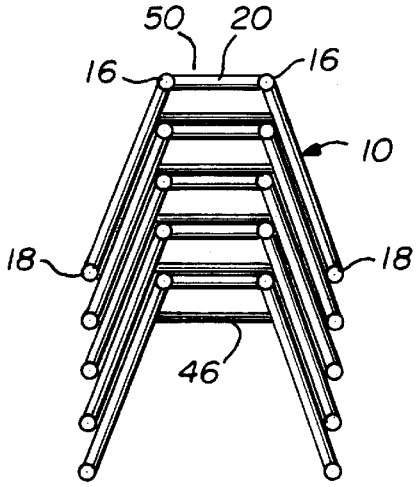
FIG. 9 is an end view of the truss of FIG. 1, stacked with four similar trusses.

It will be seen most clearly from FIGS. 1 and 7 that the truss 10 includes, at each end thereof, a tie-bar 46 extending between the side end cross chords 24. As shown in FIG. 1, each tie-bar is parallel to and below its respective end cross chord 20 and each tie-bar is located approximately 80% of the distance between an imaginary line joining the centers of the lower longitudinal spars 18 and an imaginary line joining the centers of the upper longitudinal spars 16. The tie-bar 46 serves as a brace to rigidify the truss 10. In addition, a lower surface 48 of the tie-bar is approximately the same length across the truss as, preferably slightly longer than, an upper surface of the truss in the region of the end cross chord 20. The tie-bar 46 preferably has a length along its lower surface which permits the lower surface thereof to rest on the top of a stacked truss below, with no gas or substantially no gag created between the sides of stacked trusses (see FIG. 9). Therefore, when several trusses 10 are stacked on top of one another as shown in FIG. 9, substantially all of the weight of each particular truss is transmitted down to the truss below by the engagement of the tie-bar 46 of the truss above on top of the upper surface 50 below. This prevents the lower longitudinal spars 18 of the lower trusses in the stack from splaying outwardly due to the weight of the trusses above, and therefore prevents the trusses from jamming together in the stack or potentially damaging one another. As shown in FIGS. 3 and 5, in order to prevent undesirable outward splaying of the lower longitudinal members 18 of the lowest truss 10 in the stack, the trolley 28 may be provided with side supports or side ears 52 for hindering sideways movement of the lower longitudinal spars 18 of the lowest truss.

It will be noted from FIG. 7 that, with the end cross chords 20 horizontal, the side end cross chords 24 of the truss 10 are outwardly tapered at an angle alpha which in this particular truss is 20.5 degrees from the vertical.

Figure 14:
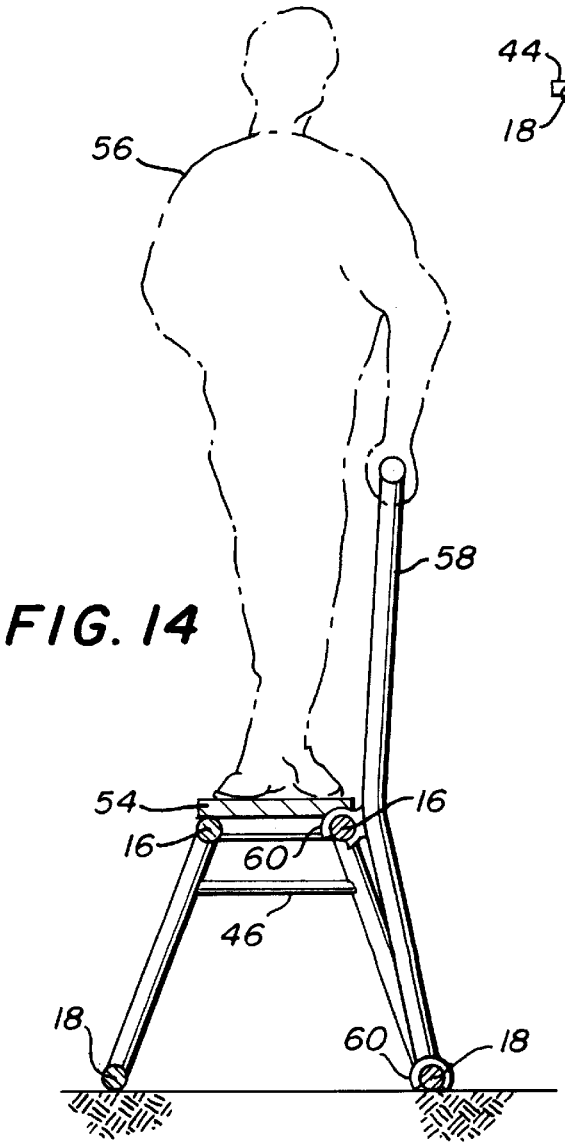
FIG. 14 is an end view of the truss of FIG. 1, showing an optional catwalk and handrail.

Turning to FIG. 14, it will be seen that a catwalk deck 54 may be secured to the truss 10 adjacent and on top of the lower longitudinal spars 16 and the end cross chords 20 and intermediate cross chords 22. The catwalk deck 54 enables a technician or performer 56 to move safely along the truss, for example when it is suspended above the ground (not shown). In addition, it will be seen that a handrail 58 may be secured to the truss by jaws 60 which engage the upper 16 and lower 18 longitudinal members.

Figure 15:
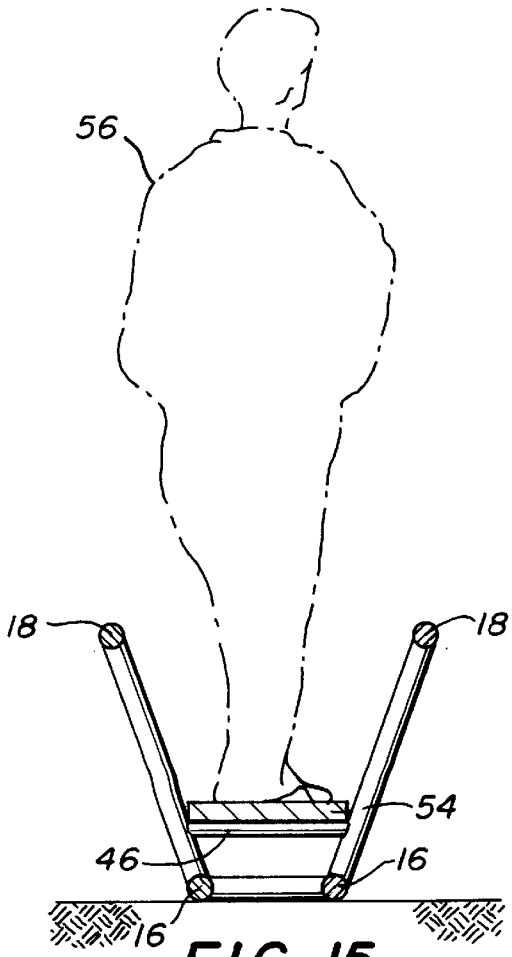
FIG. 15 is an end view of the truss of FIG. 1, in an inverted configuration, in combination with an optional catwalk.

The truss may be assembled in position in any desired orientation, with the top spars 16 having any desired orientation relative to the lower spars 18, and FIG. 15 shows the truss 10 in an inverted configuration, with the top longitudinal spars 16 now located at the bottom, and the bottom longitudinal spars 18 now located at the top. A catwalk deck 54 is secured to the truss 10 above and adjacent to the tie-bars 46, and the lower longitudinal spars 18 serve as a handrail.

The catwalk 54 and handrail 58 a preferably removed from the truss 10 before stacking.

FIGS. 10 and 11 show that lights 63 may be mounted to the truss, with the mounting point of the lights located up inside the body of the truss 10. The open nature of the lower aspect of the truss therefore not only enables stacking, but also enables lighting or any other concert equipment to be assembled in a more aesthetic manner with mounting poles 64 and ancillaries 66 such as a housing 68 containing a lighting controller (not shown) and/or a motor (not shown) for swivelling a lamp 70 of the light, located up above the lower longitudinal spars 18. The sight line produced by the lower longitudinal spars 18 substantially improves the appearance of the light 64 and truss.

In addition, as shown in FIG. 10, the tapered nature of the truss permits heat sensitive material such as a drape 72 to be hung from the truss 10 and spaced a sufficient distance from the lamp 70 to avoid overheating of the lamp 70 and the drape 72.

I claim:

1. A readily transportable truss having a body which is internestable with at least two other similar trusses in a storage configuration thereof comprising:

a first upper elongated spar and a first lower elongated spar rigidly connected parallel to each other at first and second spaced locations by a first pair of elongated members extending perpendicular between said first upper elongated spar and said first lower elongated spar;

a second upper elongated spar and a second lower elongated spar rigidly connected parallel to each other at first and second spaced locations by a second pair of elongated members extending perpendicular between said second upper elongated spar and said second lower elongated spar;

at least two cross chords rigidly connecting said first upper and said second upper elongated spars in a parallel arrangement to define a plane and form a top portion of said truss, said cross chord laying substantially in said plane, and said truss defining a trapezium cross section having an open aspect opposite said top portion;

a first tie-bar rigidly connected between the elongated member extending between said first upper spar and said first lower spar at said first location, and the elongated member extending between said second upper spar and said second lower spar at said first location, said first tie-bar spaced a selected distance from and parallel to said plane defined by said first and second upper spars;

a second tie-bar rigidly connected between the elongated members extending between said first upper spar and said first lower spar at said second location, and the elongated member extending between said second upper spar and said second lower spar at said second location, said second tie-bar spaced said selected distance from and parallel to said plane defined by said first and second upper spars; and each of said first and second tie-bars having a lower surface which is approximately the same length as the distance between the outside surfaces of said first and second upper spars such that said truss can be internested with a similar truss by engagement of said top portions formed by said first and second upper spars with the lower surfaces of said first and second tie-bars.

2. A truss as claimed in claim 1 wherein said elongated spars are preferably tubular spars.

3. A truss as claimed in claim 1 in which the spars comprise a molded or extrusion form.

4. A truss as claimed in claim 1 wherein said two upper longitudinal spars are interconnected to one another by a series of cross chords.

5. A truss as claimed in claim 4 and further comprising a cross brace which is readily attached and detached between the lower elongated spars of the truss.

6. A truss as claimed in claim 5 in which the lower elongated spars of the truss are spaced apart by the same distance as two adjacent cross chords of the series of cross chords connecting the upper spars of the truss, and the cross brace is interchangeably and selectively attached between either the two lower elongated spars or between the said two adjacent cross chords of the series of cross chords.

7. A truss as claimed in claim 1 in which the elongated spars are straight.

8. A truss as claimed in claim 1 in which the elongated spars are curved.

9. A truss as claimed in claim 1 which includes a catwalk deck attached to and extending parallel to said elongated spars.

10. A truss as claimed in claim 9 in which the catwalk deck is located adjacent the top of the truss.

11. A truss as claimed in claim 1 which includes a handrail which is removably mountable to the body.

12. The truss of claim 1 and further comprising a second similar truss to form a modular truss structure, the two trusses being joined end to end in serial alignment.

13. A truss as claimed in claim 1 in combination with a lamp, the lamp being connected to the truss inside the body of the truss.

14. A truss as claimed in claim 1 in combination with a drape, the drape hanging from one of said elongated spars of the truss.

15. A stacked truss arrangement comprising at least two trusses, each truss being as claimed in claims 1, the trusses being stacked on top of and internested with one another.

16. A stacked truss arrangement as claimed in claim 15 in which the bottom truss in the stack is supported on a trolley, in which the trolley includes side supports which are adapted to prevent outward movement of bottom portions of the bottom truss.

17. The truss of claim 1 and further including another elongated member rigidly connecting said upper and lower elongated spars other than perpendicular to said upper and lower elongated spars.

18. The truss of claim 1 wherein said rigidly connected spars, elongated members, cross chords, and tie-bars are welded.

* * * * *

UNITED STATES PATENT AND TRADEMARK OFFICE

CERTIFICATE OF CORRECTION

PATENT NO. : 6,026,626
DATED : February 22, 2000
INVENTOR(S) : Mark Eliott Fisher It is certified that error appears in the above-identified patent and that said Letters Patent is hereby corrected as shown below:

Title page,
Field "[30] Foreign Application Priority Data", the cited reference was incorrectly entered and should read as follows:
Aug. 9, 1996 [GB] United Kingdom 9616754.9
Field "[57] Abstract", in the fifth line after "transporting" and before "an", insert -- in --.

Column 3,
Line 49, after "three" and before "cross chords", delete "and" and replace with -- end --.

Column 4,
Line 12, delete "provide" and replace with -- provided --.
Line 19, delete "aspect" and replace with -- aspects --.
Line 34, delete "aspect" and replace with -- aspects --.
Line 47, delete "is" and replace with -- are --.

Column 5,
Line 33, after "22" insert -- , --.
Line 42, delete "it".
Line 44, delete " the side end cross chords 22,".
Line 47, delete "preferable" and replace with -- preferably --.

Column 6,
Line 47, delete "of".

Column 7,
Line 9, delete "as," and replace with -- or --.
Line 13, delete "gas" and replace with -- gap --.
Line 13, delete "gag" and replace with -- gap --.

UNITED STATES PATENT AND TRADEMARK OFFICE

CERTIFICATE OF CORRECTION

PATENT NO. : 6,026,626
DATED : February 22, 2000
INVENTOR(S) : Mark Eliott Fisher It is certified that error appears in the above-identified patent and that said Letters Patent is hereby corrected as shown below:

Column 7,
Line 53, after "58" and before "preferably", delete "a" and replace with -- are --.
Line 56, delete "63" and replace with -- 62 --.
Line 67, delete "64" and replace with -- 62 --.
Line 67, before ".", insert -- 10 --.

Column 10,
Line 5, delete "claims" and replace with --claim --.

Signed and Sealed this

Fourteenth Day of August, 2001

Nicholas P. Godici

*Attest:*

*Attesting Officer*

NICHOLAS P. GODICI
*Acting Director of the United States Patent and Trademark Office*